US005553904A

United States Patent [19]

Lorenzo

[11] Patent Number: 5,553,904

[45] Date of Patent: Sep. 10, 1996

[54] PROTECTING SEAL FOR SHIPPING CONTAINERS AND TRAILERS

[76] Inventor: Lorenzo Lorenzo, 1820 SW. 98th Ave., Miami, Fla. 33165

[21] Appl. No.: 430,563

[22] Filed: Apr. 28, 1995

[51] Int. Cl.[6] ..... B65D 27/30

[52] U.S. Cl. ..... 292/307 R; 292/307 B; 292/DIG. 32; 411/910

[58] Field of Search ..... 292/307 R, 307 B, 292/DIG. 32, 317; 403/23; 411/910

[56] References Cited

U.S. PATENT DOCUMENTS

| | | | |
|---|---|---|---|
| 3,172,282 | 3/1965 | Heckrotte | 411/910 X |
| 4,286,640 | 9/1981 | Knox et al. | 292/307 B |
| 4,844,524 | 7/1989 | Pastva | 292/DIG. 32 |

FOREIGN PATENT DOCUMENTS

| | | | |
|---|---|---|---|
| 2014680 | 8/1979 | United Kingdom | 411/910 |

*Primary Examiner*—Rodney M. Lindsey
*Attorney, Agent, or Firm*—J. Sanchelima

[57] ABSTRACT

A protecting seal for the doors of containers and trailers that include a rotating rod to which a locking bar pivoting housing is rigidly mounted and a locking bar that is pivotally mounted within the pivoting housing which includes a pin pivotally supporting the locking bar. The protecting seal has locking assemblies mounted to flap members extending from the longitudinal edges of a jacket member. The flap members and the jacket member embrace the rotating rod. An adhesive is used on the internal walls and surfaces to further secure the protecting seal to the rod and pivoting housing. This results in the protection of the pivoting pin mounted to the pivoting housing.

6 Claims, 2 Drawing Sheets

PROTECTING SEAL FOR SHIPPING CONTAINERS AND TRAILERS

BACKGROUND OF THE INVENTION

1. Field of the Invention

The present invention relates to a seal, and more particularly, to the type that protects the doors of shipping containers and trailers from tampering.

2. Description of the Related Art

Applicant believes that many types of protective mechanisms to secure the contents of containers and trailers exist today. However, none of them discloses the characteristics of the seal described in the present invention. In the shipping industry, a seal is typically used to prevent and/or deter the unauthorized opening of containers and trailers. It is also relied on for readily ascertaining whether a door's locking mechanism has been tampered with. However, many times a wrongdoer removes the pin of the locking bar pivoting housing leaving the conventional seal intact. Once the pin is removed, the locking bar can either be easily slid out or lowered from the housing. This leaves the locking bar free to turn and unlock the container door. The present invention protects that pin.

SUMMARY OF THE INVENTION

It is one of the main objects of the present invention to provide a device that protects and/or deters the tampering with the locking mechanism of container and trailer doors.

It is another object of this invention to provide a device that conspicuously shows when the pin of the locking bar pivoting housing has been tampered with, thereby stopping the transfer of responsibility and holding the party in procession of the container at that time responsible for any missing cargo.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
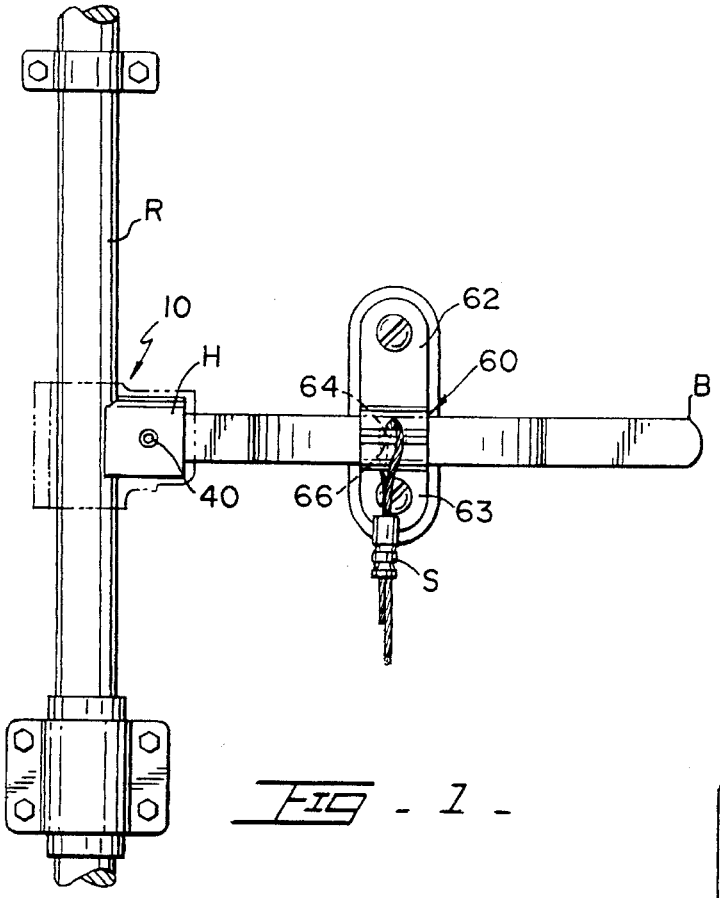
FIG. 1 represents an elevational view of a locking mechanism of a container door using the present invention, shown in phantom, to protect a locking bar pivoting housing.

Referring now to the drawings, where the present invention is generally referred to with numeral 10, it can be observed that it basically includes jacket member 11, sleeve member 14, opening 16 and flaps 17 and 18 with locking assemblies 20 mounted at then ends of flaps 17 and 18. In the preferred embodiment, protecting seal 10 is made out of a rigid, resilient, and weather resistant material.

Figure 2:
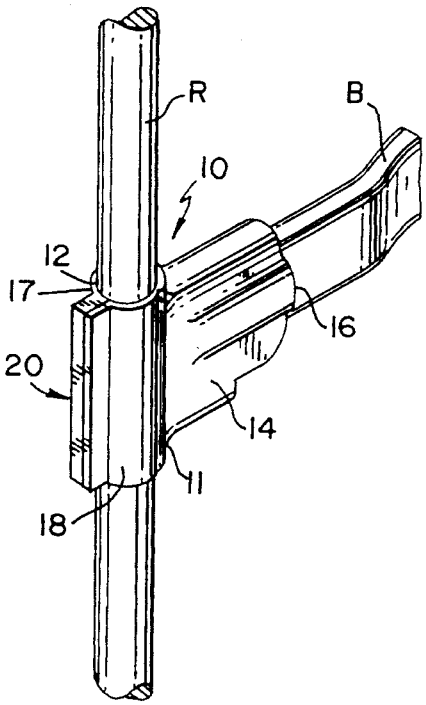
FIG. 2 shows a partial isometric view from the top of the present invention covering the locking bar pivoting housing of the locking mechanism.
Figure 3:
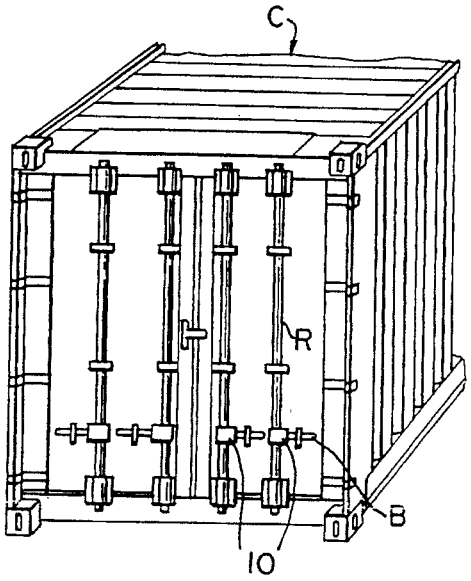
FIG. 3 is a partial illustration of a container C using the present invention.
Figure 4:
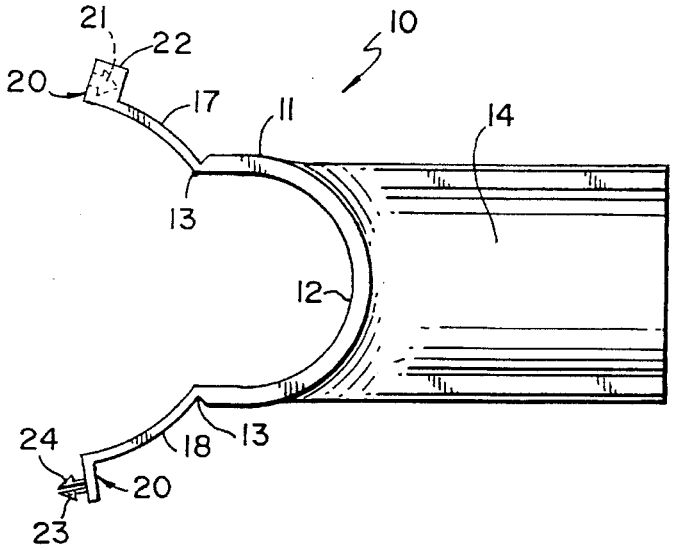
FIG. 4 illustrates a top view of the embodiment shown in FIG. 2.
Figure 5:
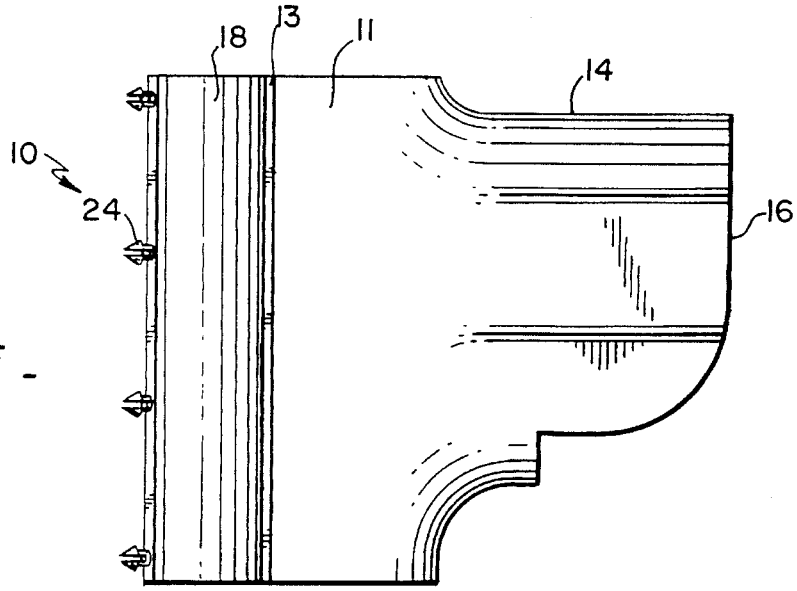
FIG. 5 illustrates an elevational side view of the present invention.
Figure 6:
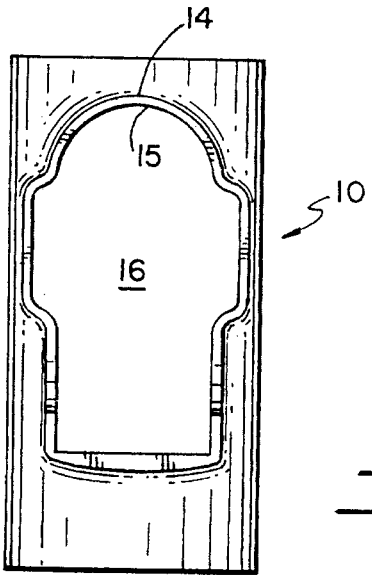
FIG. 6 shows an elevational rear view of the embodiment shown in FIG. 5.

Jacket member 11 and sleeve 14 are perpendicularly disposed with respect to each other and adapted to receive locking bar B. Jacket member 11 extends longitudinally to embrace rod R. In the preferred embodiment, inner wall 12 of jacket member 11 comes in snug contact with rod R, as shown in FIG. 2. Flaps 17 and 18 extend from the longitudinal edges 13 of jacket member 11. Flaps 17 and 18 are, in the preferred embodiment, hingedly mounted to jacket member 11 at edges 13. Flaps 17 and 18 end with locking assemblies 20. Locking assemblies 20, in the preferred embodiment, include female and male members 22 and 24, respectively. Male members 24 slide within female members 22 by applying sufficient force that will bring together the bifurcated heads 23 of male members 24. Once inside cavities 21, the resilient bifurcated heads 23 separate lodging themselves firmly within cavities 21. The preferred locking assembly 20 is of the type that it cannot be unlocked or release without destroying it. In FIG. 1 protecting seal 10 is shown in phantom covering locking bar pivoting housing H and partially embracing rod R.

The most common locking mechanism in shipping containers today corresponds to seal S, as is illustrated in FIG. 1. A user locks the doors of a container by placing bar B behind latch members 62 and 63. Latch members 62 and 63 have slots 64 and 66 through which seal S passes. At the receiving end, unless seal S is intact, the merchandise is not accepted. This is the conventional manner of conducting business. Latch member 62 is pivotally mounted to the door of the container and permits bar B to engage with latch members 62 and 63. Bar B is pivotally mounted at one end to pivoting housing H by pin 40. Protecting seal 10 is designed to protect pin 40. In this manner, any attempts to remove pin 40 of locking bar pivoting housing H are easily detected since seal 10 would have to be broken.

To further secure device 10 to rod R and housing H, a user may add an adhesive or contact cement to inner surface 15 of sleeve member 14 and/or inner wall 12 of jacket member 11.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A protecting seal for doors of containers and trailers that include a rotating rod to which a locking bar pivoting housing is rigidly mounted and including a locking bar that is pivotally mounted within said pivoting housing further including a pin mounted therein for pivotally connecting said locking bar, and said protecting seal comprising:

A) sleeve means for receiving said locking bar and including an inner surface; and B) jacket means perpendicularly mounted to said sleeve means, said jacket means including an inner wall that comes in contact with said rod, and said jacket means further including longitudinally extending edges and flap members that extend outwardly from said edges to cooperatively and partially embrace said rod thereby protecting said pin against tampering.

2. The seal set forth in claim 1 further including:

C) locking means rigidly mounted to said flap members and so designed and constructed to keep said flap members against said rod.

3. The seal set forth in claim 2 wherein said locking means cannot be unlocked without destroying said locking means.

4. The seal set forth in claim 3 wherein said sleeve means, jacket means and flap members are made out of a rigid, resilient and weather resistant material.

5. The seal set forth in claim 4 wherein said flap members include each a distal end to which said locking means are mounted.

6. The seal set forth in claim 5 further including adhesive means applied to said inner wall and inner surface.

* * * * *